US007433641B2

(12) United States Patent
Kikuchi et al.

(10) Patent No.: US 7,433,641 B2
(45) Date of Patent: Oct. 7, 2008

(54) FIXING MEMBER, FIXING DEVICE, AND IMAGE FORMING APPARATUS

(75) Inventors: Hisashi Kikuchi, Kanagawa (JP); Toshihiko Baba, Chiba (JP); Shigeo Kurotaka, Kanagawa (JP); Atsushi Nakafuji, Tokyo (JP); Hiroyuki Kunii, Kanagawa (JP); Yukimichi Someya, Saitama (JP); Katsuhiro Echigo, Saitama (JP); Takashi Fujita, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 11/199,087

(22) Filed: Aug. 9, 2005

(65) Prior Publication Data

US 2006/0019082 A1 Jan. 26, 2006

Related U.S. Application Data

(63) Continuation of application No. 10/753,387, filed on Jan. 9, 2004, now Pat. No. 6,957,036.

(30) Foreign Application Priority Data

Jan. 10, 2003 (JP) ..... 2003-004238

(51) Int. Cl.
*G03G 15/20* (2006.01)

(52) U.S. Cl. ..... 399/333; 399/328

(58) Field of Classification Search ..... 219/216, 219/619; 399/320, 328–330, 333
See application file for complete search history.

(56) References Cited

U.S. PATENT DOCUMENTS 5,939,337 A * 8/1999 Hatakeyama et al. ..... 442/6
6,463,250 B1 * 10/2002 Chen et al. ..... 399/330
6,605,802 B2 8/2003 Nagahira
6,713,734 B2 3/2004 Suzuki
6,730,878 B2 5/2004 Hirai
6,957,036 B2 * 10/2005 Kikuchi et al. ..... 399/333
2006/0019082 A1 1/2006 Kikuchi et al.

FOREIGN PATENT DOCUMENTS

JP 08-220916 8/1996
JP 2000-192943 7/2000
JP 2000-242108 9/2000

(Continued)

OTHER PUBLICATIONS

U.S. Appl. No. 11/699,817, filed Jan. 31, 2007, Suzuki et al.

(Continued)

*Primary Examiner*—Hoang Ngo
(74) *Attorney, Agent, or Firm*—Oblon, Spivak, McClelland, Maier & Neustadt, P.C.

(57) ABSTRACT

A fixing member heat bonds a toner on a recording material. The fixing member includes a releasing layer, a layer of elastic material, below the releasing layer, and a layer of adiabatic and hygroscopic material, below the layer of elastic material. The layer of elastic material includes a layer of electrically conducting material to pass electric currents, an adiabatic, elastic, and hydrophobic material, and a porous material to the release of the moisture absorbed by the layer of adiabatic and hygroscopic material.

15 Claims, 13 Drawing Sheets

FOREIGN PATENT DOCUMENTS

| | | |
|---|---|---|
| JP | 2001-076845 | 3/2001 |
| JP | 2001-201966 | 7/2001 |
| JP | 2001-312168 | 11/2001 |
| JP | 2002-049260 | 2/2002 |
| JP | 2002-222689 | 8/2002 |
| JP | 2002-334774 | 11/2002 |

OTHER PUBLICATIONS

U.S. Appl. No. 11/681,739, filed Mar. 2, 2007, Seto et al.
U.S. Appl. No. 11/683,086, filed Mar. 7, 2007, Takemoto et al.

* cited by examiner

FIXING MEMBER, FIXING DEVICE, AND IMAGE FORMING APPARATUS

CROSS-REFERENCE TO RELATED APPLICATIONS

The present document incorporates by reference the entire contents of Japanese priority document, 2003-004238 filed in Japan on Jan. 10, 2003.

BACKGROUND OF THE INVENTION

1) Field of the Invention

The present invention relates to a fixing member that employs an electro magnetic induction heating to fix an image to a recording member.

2) Description of the Related Art

An image forming apparatus that employs a toner in order to form a visible image is provided with a fixing device to fix a toner image on a recording material. Different approaches are used to perform the fixing: apply heat and/or pressure to the toner image, use a solvent and the like. However, application of heat or pressure has been the most popular method. A fixing device that applies heat (hereinafter, "heat fixing method") includes a fixing roller and a pressure member that is in pressure contact with the fixing roller. The fixing roller is heated and then the recording material that bears the toner image is passed between the fixing roller and the pressure member. As a result, the toner image is fixed on the recording material. In a variation, the toner image is transferred from an intermediate transfer drum on to a fixing member and then the toner image on the fixing member is fixed to the toner image on the recording material.

However, in the heat fixing method, the conversion of energy is inefficient, the power consumption is high, and the warming up time is long. To overcome these problems, eddy currents heating method and induction heating method came to be used. In the eddy currents heating method the fixing roller is heated by the eddy currents due to the electromagnetic waves, while in the induction heating method, a fixing roller that is formed from a metal conductor is heated by energizing a heating element. These direct heating methods proved highly efficient; because, the heating time is very less. These heating methods also gained popularity since the rigidity of the fixing roller was not affected by the heat.

Many patents related to the direct heating methods have been disclosed, some of which are mentioned below. See, for example, Japanese Patent Laid-Open Publication No. 2000-242108. In the technology disclosed in this publication, a heating belt is placed opposite to an electromagnetic induction heating device. The heating belt includes a heat-resistant resin or rubber base on which is disposed an organic conductive layer having the property of heating by electromagnetic induction and which gets heated by an eddy current loss. Alternatively, the heating belt may include a non-woven fiber base and on which is disposed a conductive layer having the property of being heated by electromagnetic induction and which gets heated by an eddy current loss.

Japanese Patent Laid-Open Publication No. 2002-334774 also discloses a related technology. In the technology disclosed in this publication, a fixing member is equipped with a high frequency source HFS that outputs high frequency of over 100 kHz, an induction coil IC biased by the high frequency output of the high frequency source HFS, and a fixing roller HR. The fixing roller HR has a conductive layer of a thickness less than that of the skin, and the conductive layer gets heated by the secondary current flowing in the induction coil IC in the circumferential direction.

In the fixing member employing direct heating method, it is required that the layers of the fixing member are in tight contact. Otherwise, heat conduction is not uniform and efficient and problems such as unevenness of temperature, reduced resistance to pressure, etc. may arise. Particularly, in a high-temperature and high-moisture environment (for instance a temperature of 30 degrees and humidity of 70%) such as during the rainy season of the inventor's country, if moisture absorption in a layer exceeds 0.07 mg/cm$^2$, during heating a sharp expansion takes place due to evaporation and as a result the conductive layer peels off.

A solution for such a problem is provided in Japanese Patent Laid-Open Publication No. 2001-201966. This publication discloses a heat generating roller in which is provided a resistive element through an insulation on the inner perimeter of the base material. This forms a bump on the inner perimeter of the base material. The concave portion and the opening in the insulation layer for ventilation open to the outside. However, since the heat producing part is separated from the surface layer, the rise time is somewhat longish for a direct heating method.

In recent times, the popularity of color image forming apparatuses is on the increase. There is a demand for realizing high-quality pictures by realizing a fixing member with a surface which is flexible enough to allow toners of multiple colors to be uniformly transferred to a recording material by pressure.

However, in the structure described in Japanese Patent Laid-Open Publication No. 2001-201966, the inner perimeter of the metal base has plural layers such as heat-producing layer (conductive layer), etc. This adversely affects the flexibility of the surface of the heating roller. Further, for the regular high frequency of 20 kilohertz (kHz) to 100 kHz used in the electromagnetic induction in the structure disclosed in patent literature 1, the thickness organic conduction layer (skin thickness) should preferably be 1 micrometer (μm) to 50 μm. The conductive layer which has a thickness of this range is bound to have poor flexibility.

SUMMARY OF THE INVENTION

It is an object of the present invention to solve at least the problems in the conventional technology.

A fixing member according to one aspect of the present invention heat bonds a toner on a recording material by heating and includes a releasing layer, a layer of elastic material, below the releasing layer, and a layer of adiabatic and hygroscopic material, below the layer of elastic material. The layer of elastic material includes a layer of electrically conducting material to pass electric currents, an adiabatic, elastic, and hydrophobic material, and a porous material to the release of the moisture absorbed by the layer of adiabatic and hygroscopic material.

A fixing member according to one aspect of the present invention heat bonds a toner on a recording material by heating and includes a releasing layer; a first layer of adiabatic and hydrophobic material, below the releasing layer; a layer of electrically conducting material, below the first layer, to pass electric currents; and a second layer of adiabatic and hydrophobic material, below the layer of electrically conducting material, wherein at least one of the first layer and the second layer is made of elastic material.

A fixing device and an image forming apparatus according to other aspects of the present invention employ the fixing member according to the present invention.

The other objects, features, and advantages of the present invention are specifically set forth in or will become apparent from the following detailed descriptions of the invention when read in conjunction with the accompanying drawings.

DETAILED DESCRIPTION

Figure 1:
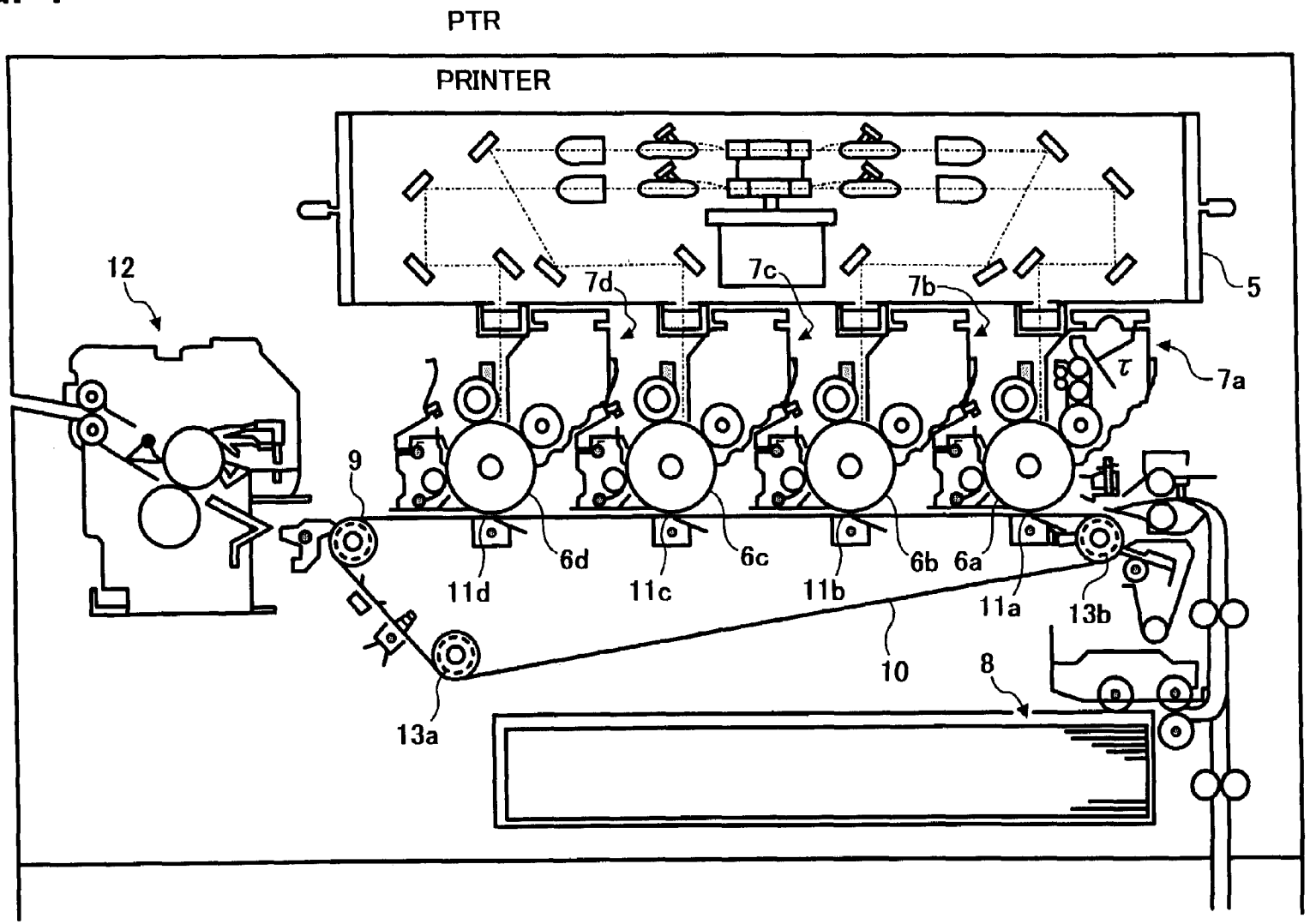
FIG. 1 is an overall view of an image forming apparatus according to an embodiment of the present invention.

Exemplary embodiments of a fixing member, a fixing device, and an image forming apparatus according to the present invention are explained in detail next with reference to the accompanying drawings. FIG. 1 illustrates a digital color printer employing a tandem system to which the present invention is applicable. The overall structure of the image forming apparatus is identical to the conventional image forming apparatus.

This color printer includes an assembly of an image scanner, an automatic document feeder (ADF), a sorter, and other devices (the color printer being essentially a multi-function digital color copier). An image scanner has been omitted for the sake of simplification of the explanation. The color printer comprises four image-creating units along the edge of a transfer belt 10 of a conveying belt unit. The image-creating unit creates a toner image of each of the four colors, namely, yellow, magenta, cyan, and black (In the figures, the four colors are represented by a, b, c, and d, respectively). The transfer belt is an endless belt that is supported by a driving roller 9, a tension roller 13*a*, and a driven roller 13*b*. The tension of the transfer belt 10 is maintained almost uniformly as the tension roller 13*a* pushes down the transfer belt 10 with a not shown spring.

Each image-creating unit has an image carrier in the form of a photosensitive drum 6. When an image data of each color is sent to a writing unit (multi-beam writing) 5, the photosensitive drum 6 is rotated in the counter-clockwise direction by a not shown driving device, and a laser beam exposes the image data unit by unit in accordance with the image data on the photosensitive body 6 which is uniformed charged by a charging unit. A latent image is formed on the photosensitive body 6 due to this exposure. A developing unit 7 develops this latent image into a toner image. The toner image then is transferred to a position that faces the transfer belt 10.

Meanwhile, a paper feeder 8 feeds a sheet. The sheet is carried by a resist roller on the transfer belt 10 at the same time as the toner image. A transferring unit 11 transfers the toner image to the sheet.

In a full color printing process, while a yellow toner image formed in the first image-creating unit is being transferred to the sheet, a latent image of magenta color is formed on the second image-creating unit and upon development of the latent image by the developing unit 7 into a magenta toner image, the magenta toner image is transferred to the sheet, thus obtaining a magenta toner image superposed on the yellow toner image. Similarly, a cyan toner image and a black toner image are formed and superposed on the sheet. The sheet containing the superposed toner images of the four colors is detached from the transfer belt 10 and carried to a fixing unit 12. A cleaning unit removes the residual toner after transfer of the toner image on each of the photosensitive bodies, readying the photosensitive bodies for the next round of image formation process.

Figure 2:
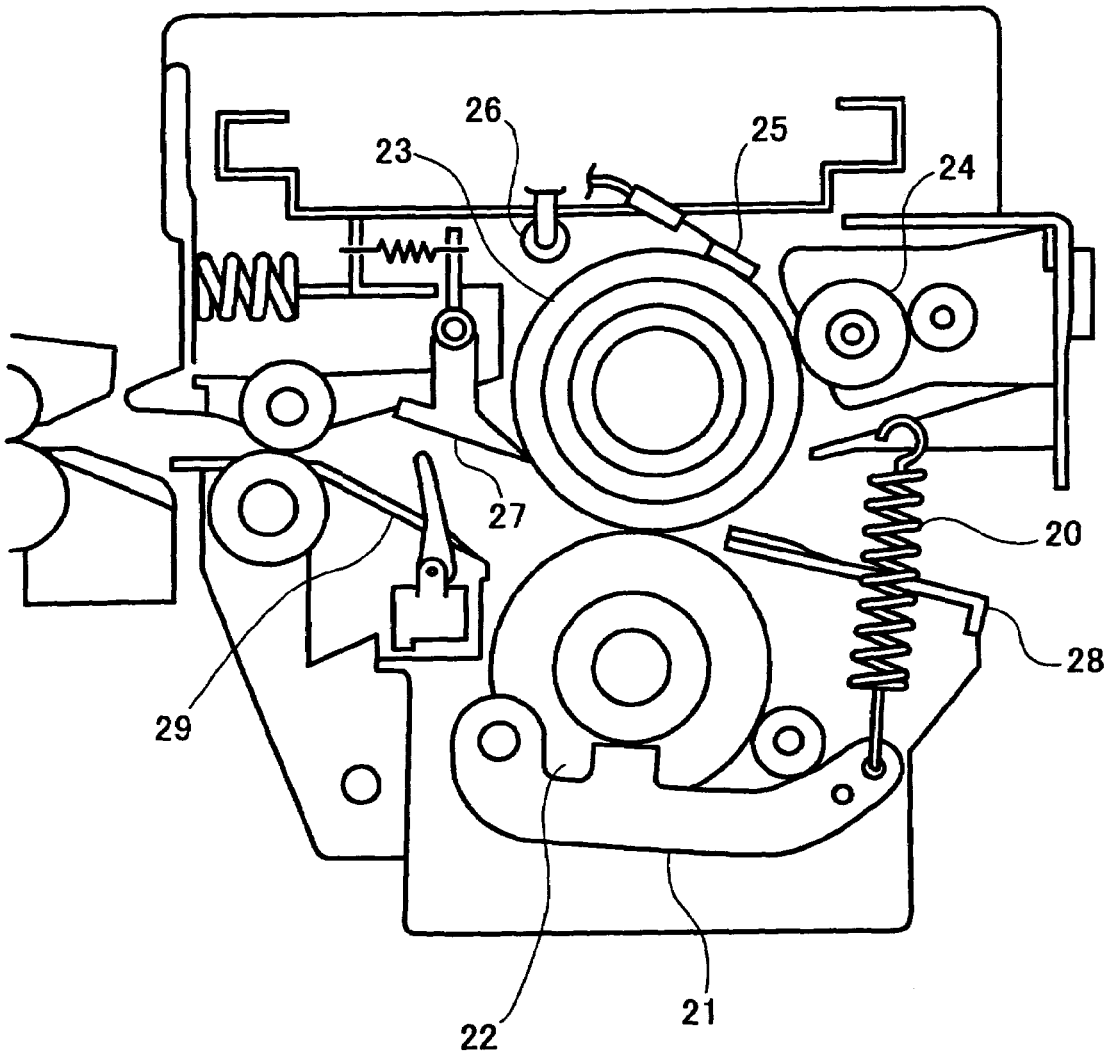
FIG. 2 is a schematic diagram of a fixing device according to an embodiment of the present invention.

FIG. 2 is a detailed drawing of the fixing unit 12. A fixing roller 23 is in pressure contact with a pressure roller 22 because of a pressure spring 20 and a pressure arm 21. The fixing roller 23 rotates in clockwise direction. The sheet having the unfixed toner images is held between the fixing roller 23 and the pressure roller 22 and is transferred towards left in the drawing. An oil-coated roller 24, a thermistor 25, a temperature fuse 26, and a separating nail 27 are disposed around the fixing roller 23. A paper guide plate 28 is disposed opposed to the nip formed by the pressure roller 22 and the fixing roller 23. A discharge guide plate 29 is disposed opposed to the nip, on the other side of the paper guide plate 28, and ejects the sheet after fixing is completed. The pressure roller 22 may for instance be a sponge roller.

Figure 3B:
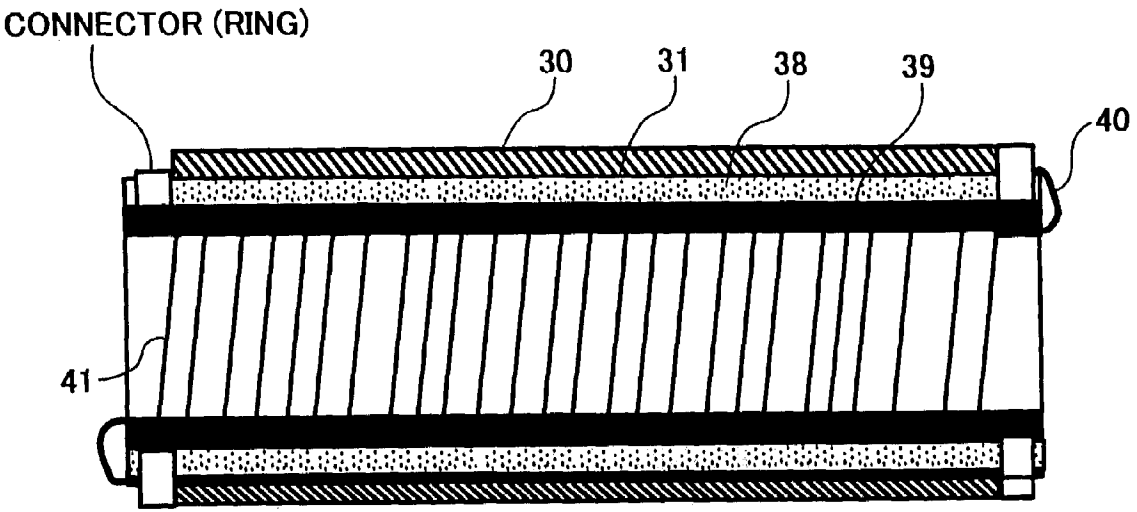
FIG. 3B is a cross-sectional view parallel to the rotational axis of the fixing roller.
Figure 3A:
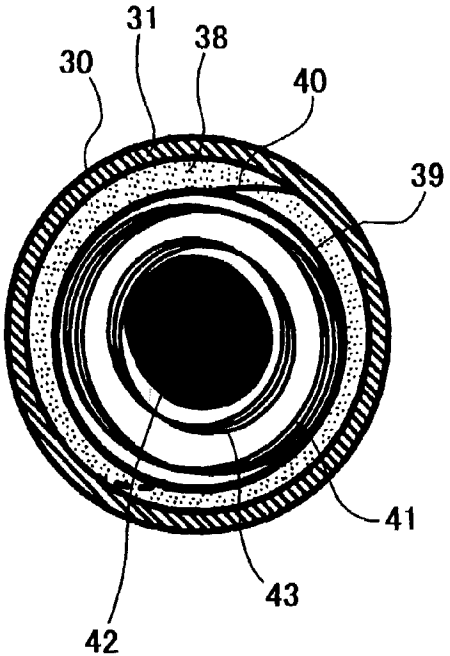
FIG. 3A is a cross-sectional view perpendicular to a rotational axis of a fixing roller of the fixing device.

FIG. 3A is a cross-sectional view perpendicular to a rotational axis of the fixing roller 23, and FIG. 3B is cross-sectional view parallel to the rotational axis. The outermost layer is a releasing layer 30. Beneath the releasing layer 30 are an intermediate elastic layer 31 and an adiabatic layer 38. The intermediate elastic layer 31 and the adiabatic layer 38 are supported by a base 39. The base 31 is insulating and is made of, for example, glass. The intermediate elastic layer 31 includes a conductive layer which is electrically connected to a secondary coil 41 on the base 39 side through a connector 40. The center of the fixing roller 23 has a core 42 around which a primary coil 43 is wound. The electromagnetic induction between the primary coil 43 and the secondary coil 41 generates heat in the conductive layer.

Figure 4:
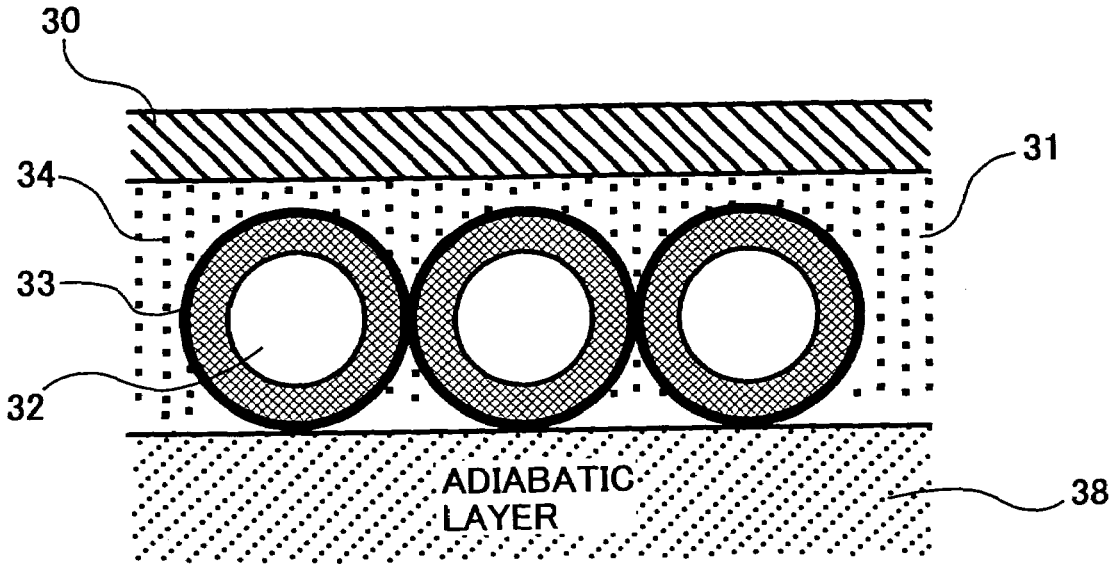
FIG. 4 is an example of a structure of a fixing member.
Figure 5:
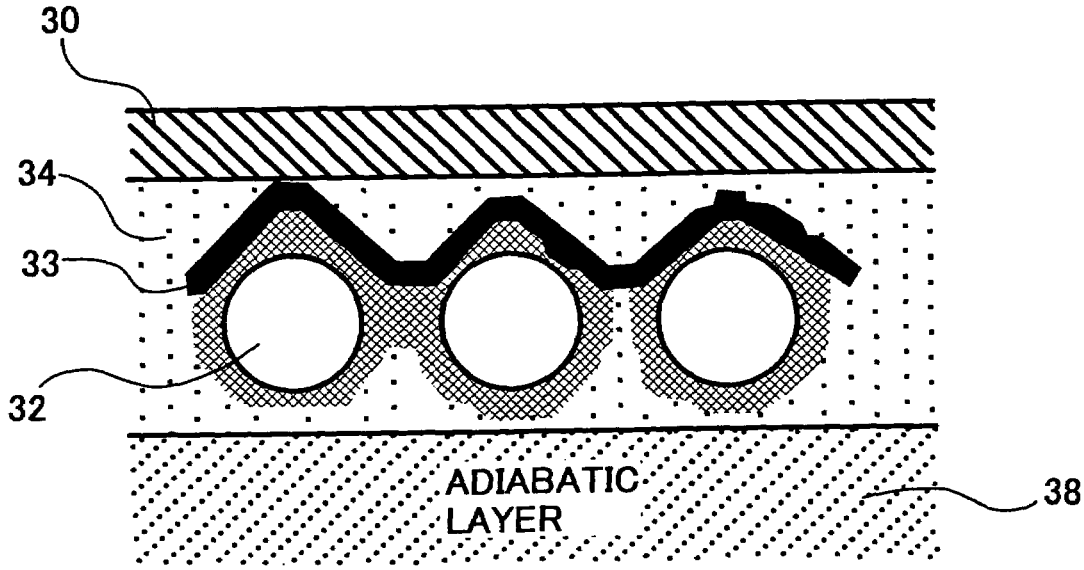
FIG. 5 is another example of a structure of the fixing member.
Figure 9:
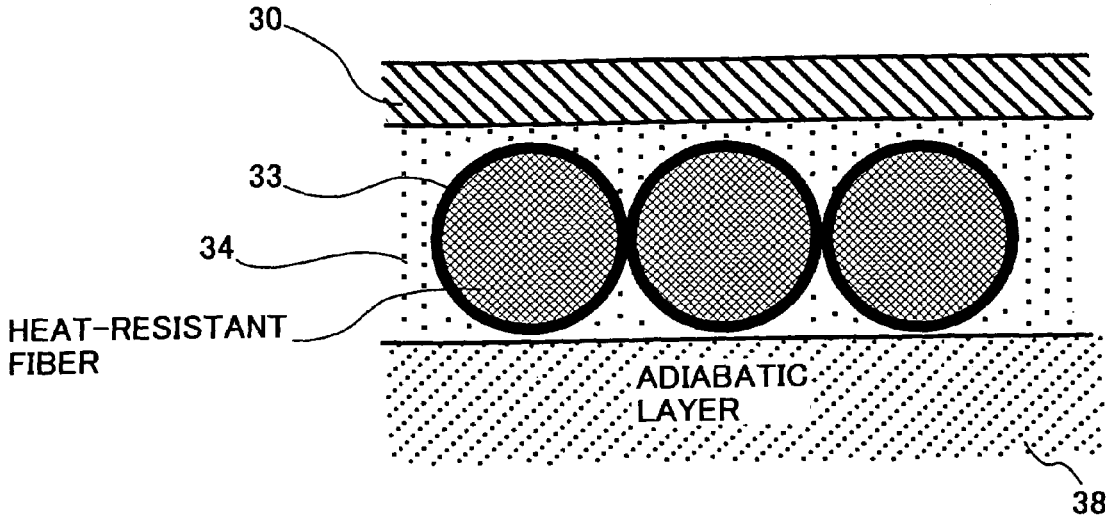
FIG. 9 is an example of a structure of a fixing member used for comparison.
Figure 10:
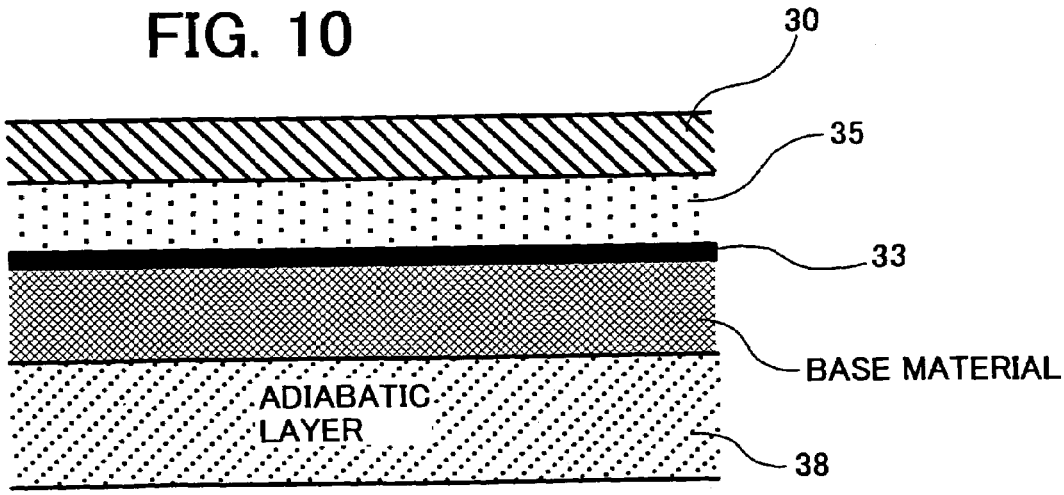

FIG. 4 through FIG. 8 illustrate the detailed structure of the intermediate elastic layer 31. In order to make the explanation of the features of this layer clearer, FIG. 9 and FIG. 10 are provided as examples for comparison. The adiabatic layer 38 is about 1 μm to 5 μm thick and is made of a heat-resistant resin or rubber. The releasing layer 30 is about 10 pm to 30 pm and is made of fluorocarbon resin such as PFA resin. As shown in FIG. 4 and FIG. 5, the intermediate elastic layer 31 may be include hollow fibers 32 having an outer diameter of 50 μm to 300 μm and an inner diameter of 40 μm to 290 μm and each of the hollow fibers 32 having an external cladding of a conductive layer 33. The hollow fibers 32 are disposed parallel to each other and are bound together as a single unit by a binder in the form of a hydrophobic heat-resistant rubber 34. The hollow fiber 32 is made of a hygroscopic heat-resistant material such as polyester, polyimide, polyamide-imide, polybenzoimidazole. As shown in FIG. 4, each of the hollow fibers 32 may have separate conductive layer 33, or as shown in FIG. 5, the hollow fibers 32 may have a common conductive layer 33. There may be two or more layers of the hollow fibers. When there are many layers of the hollow fibers, and if a conducting layer is not provided in the bottom-most layer, this layer may function as an adiabatic layer.

Figure 6:
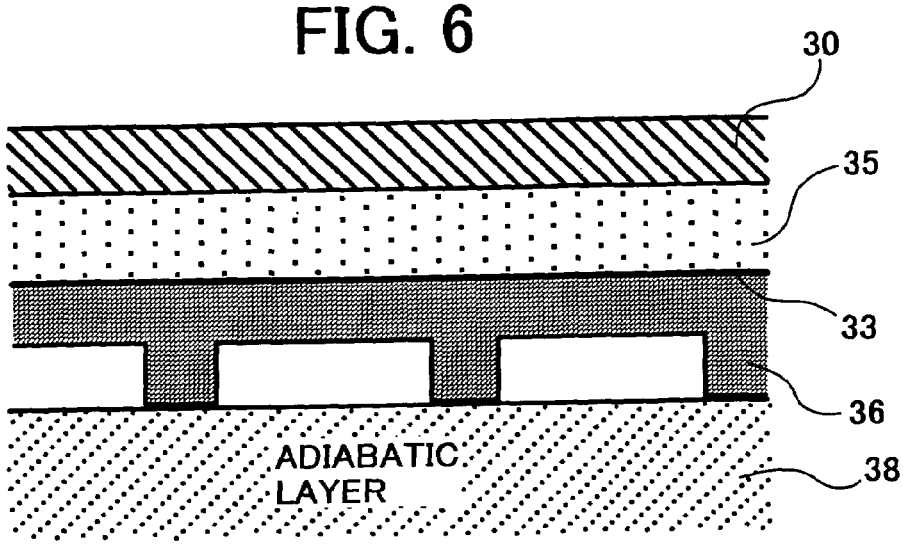
FIG. 6 is still another example of another fixing member.
Figure 7:
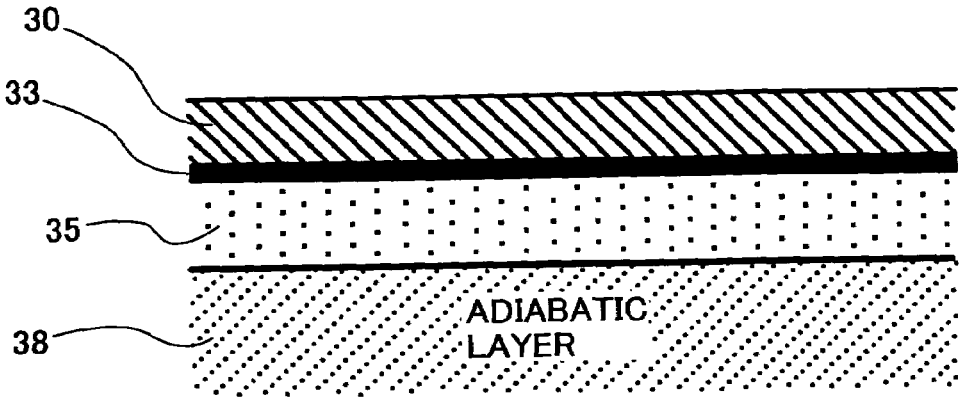
FIG. 7 is still another example of another fixing member.
Figure 8:
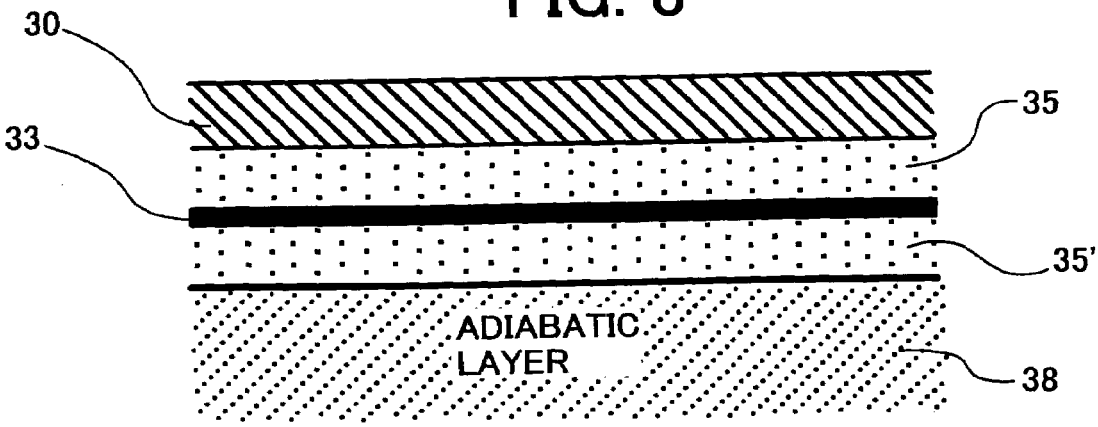
FIG. 8 is still another example of another fixing member.

In the structures illustrated in FIG. 6 through FIG. 8, the conductive layer 33 is invested with the function of a sheet heating member that uses induction current. In FIG. 6, the conductive layer 33 is sandwiched the heat-resistant rubber layer 35 that ensures surface flexibility, and the base material 36 that is made of a hygroscopic material, such as polyimide, etc., so as to generate space for moisture elimination. The surface of the polyimide base material 36 on the side opposite to the one that has the conductive layer 33 has a bump (20 μm to 200 μm in height, and 20 μm to 50 μm in width) and is in close contact with the adiabatic layer 38 beneath it. In the structure illustrated in FIG. 7, the conductive layer 33 is disposed beneath the releasing layer 30. The heat-resistant rubber layer 35 is disposed beneath the conductive layer 33. In the structure illustrated in FIG. 8, the conductive layer 33 is disposed between two heat-resistant rubber layers 35 and 35' beneath the releasing layer 30. In FIG. 9, which is provided for comparison, solid hygroscopic heat-resistant fibers are used instead of hollow fibers. In FIG. 10, the hygroscopic base material does not have a bump.

The conductive layer 33 is formed by conductive macromolecule material obtained by polymerization of pyrrol or its derivatives. Copper sulfuration is a well-known metal sulfuration process. Copper sulfuration is a process by which sulfurated copper is chemically bonded to the surface of a resin base material. To explain the chemical binding in further detail, binding of sulfurated copper to the resin typically involves interaction between an ion of the resin whose surface has a functional group that can capture a metal ion and an aqueous bath that includes a thiosulphate ion. Thunderon, manufactured by Nihon Sanmo Dyeing Co., is a typical industrial product obtained by processing the surface of a base material such as a fiber with sulfurated copper.

Pyrrol, N-methyl pyrrol, aniline, thiophane, thiophane-3-sulfonic acid or a polymer or copolymer obtained by polymerizing these monomer conductive materials can be used as conductive macromolecule materials. ST-poly, manufactured by Achilles Corporation, is a typical industrial product formed from polypyrrol. Conductive organic polymers of monomers such as Pyrrol and thiophane are preferable from the point of view of contact strength, conductivity, and ease of processing of the conductive layer 33. When cladding the surface of the fiber with the conductive polymer (or when impregnating the fiber with the conductive polymer), the layer thickness is kept between 0.02 μm to 0.05 μm bearing in mind the heat resistivity. The thickness of the conductive layer 33 of the conductive polymer varies with the diffusion conditions of the processing liquid used during the conductivity process. When polymerization is carried out using oxygenated polymerization agent as a catalyst by submerging the base fiber in the processing fluid, the conductive polymer thus generated either adheres to the surface of the fiber or forms a cladding on the surface or infiltrates into the fiber material. Thus, the conductive organic polymer and the base fiber together form the conductive layer 33. Either water or a mixture of water and organic solvent can be used as the processing fluid, also known as a solvent of the polymerization system, depending on the surface conditions of the base material and the diffusion conditions.

Copper sulfurization process is another well-known conductivity process. In this process, sulfurated copper is cladded on the surface of the base material according to sufurated copper plating method. Other methods include cladding metals such as nickel, aluminium, etc. According to electroless metal plating method, binding with a binding agent a metal foil or a thin sheet of metal on the organic conductive layer, etc. However, electro plating or chemical plating is preferable from the viewpoint of obtaining a metal layer of uniform thickness over the organic conductive layer. For instance, a phosphorous eutectoid plating such as Ni—P, Fe—P plating can be obtained by adding a phosphate compound while bathing the base material. Similarly, a carbon eutectoid plating such as Ni—C, Fe—C plating can be obtained by adding a carboxylate compound. Alternatively, a boron eutectoid plating such as Ni—B, Fe—B plating can be obtained by adding boron compounds. Particularly, when metal-plating the organic conductive layer, it is preferable to first chemically etch the surface, then form a thin alloy plating layer by phosphorous plating, carbon plating or boron plating, and finally form a metal layer of desired thickness over the thin alloy plating layer by electro plating or chemical plating. The plating layer can be firmly bound on the surface by the above method. Instead of plating process, the metal layer may also be formed by vacuum deposition, sputtering, etc. These methods may be employed for metals which do not yield themselves to plating.

Upon placing the fixing rollers having the structures illustrated in FIG. 4 through FIG. 10 under an environment mimicking the rainy season, that is, at an average temperature of 30° C. and a relative humidity of 70%, it was noted that in the structures according to FIG. 9 and FIG. 10 the conductive layer pealed off due to the moisture, whereas in the structures according to FIG. 4 through FIG. 8, the conductive layer remained intact.

When the conductive layer is formed within the releasing layer 30 made of fluorocarbon resin, as shown in FIG. 7, the adhesion is not very good. However, the adhesion can be improved by laying the conductive layer after laying a thin layer of primer on the releasing layer side of the heat-resistant rubber layer 35. The primer layer is hard and may be hygroscopic. Therefore the thickness of the primer layer should be kept between 0.5 μm to 2 μm so that it does not affect the flexibility of the surface. If a tube of fluorocarbon resin is used as a releasing layer, the fluorocarbon from the inner surface of the tube should be desorbed by conventional methods such as laser ablation, ammonia process, natrium naphthalene process, etc. and the exposed layer should be chemically activated followed by laying of the conductive layer and then the primer layer to establish contact with the adiabatic layer, etc. Laser ablation is a preferable mode of desorption since in the other methods desorption process involves using fluid and the subsequent filtering out of the fluid which result in creases and folds in the tube. Laser ablation is particularly preferred for obtaining good quality images in image forming apparatuses of resolution of over 600 dpi.

When the conductive layer is disposed between two heat-resistant rubber layers, as shown in FIG. 8, the durability of the conductive layer is good irrespective of the process used for laying the conductive layer, as long as the deformation amount of the portion of the heat-resistant layer which includes the conductive layer is within 10% of the result obtained by the finite element method.

FIG. 11A through FIG. 11J illustrate various structures of magnetic circuits. The magnetic circuit is formed by placing appropriately a highly magnetically permeable and a high resistance material such as soft ferrite. The heat-producing efficiency of the conductive layer can be increased by forming the magnetic circuit.

Figure 11B:
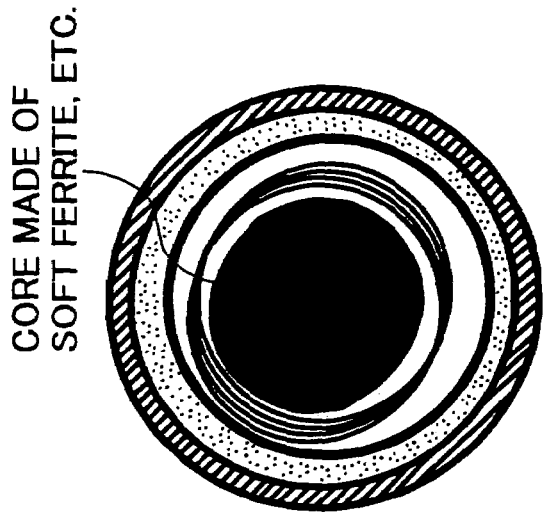
FIG. 11A through FIG. 11J are conceptual drawings of various magnetic circuit structures.
Figure 11A:
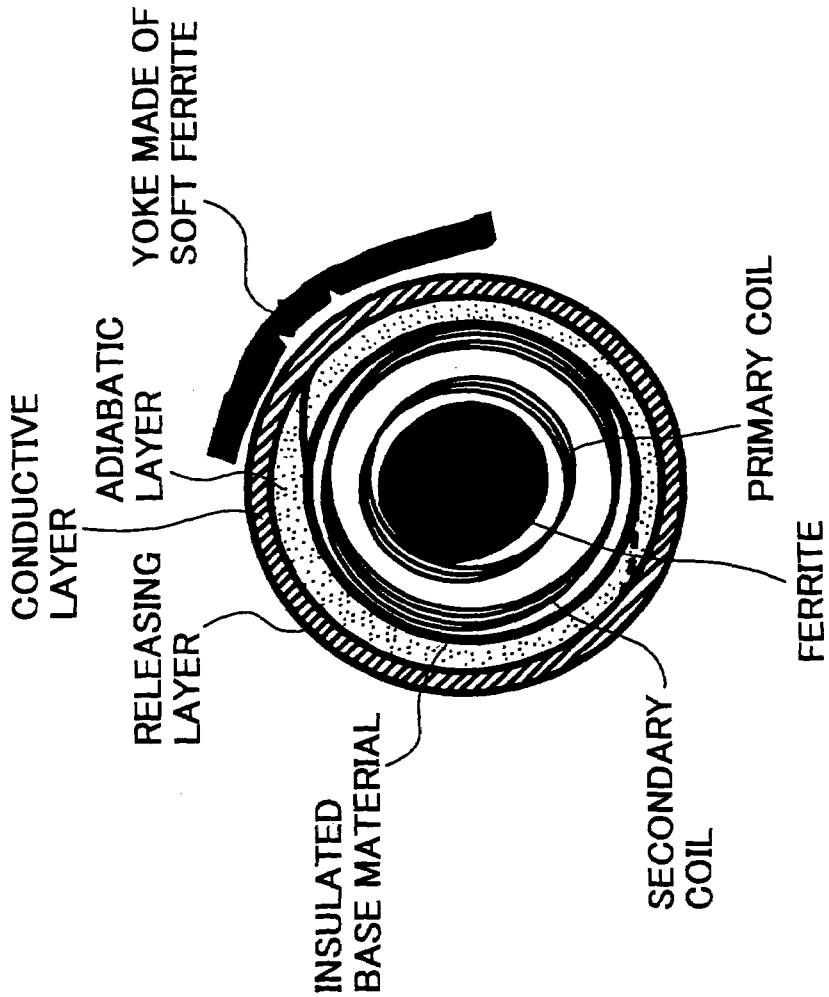

FIG. 11A, a yoke is provided external to the fixing member in the structure illustrated in FIG. 3. In the structure illustrated in FIG. 11B, the primary coil wound around the core is fixed inside the fixing member and the electromagnetic induction current is directly induced in the conductive layer instead of being produced in the secondary coil. When the frequency exceeds 500 kHz, the coupling factor of the electromagnetic coupling increases. Hence, the core can be dispensed with in all the cases except in the structure illustrated in 11A. FIG. 11C illustrates a structure in which a yoke is placed external to the structure shown in FIG. 11B. The opening of the fixing member can be heated in a concentrated manner as the lines of magnetic force are concentrated on the yoke side.

Figure 11D:
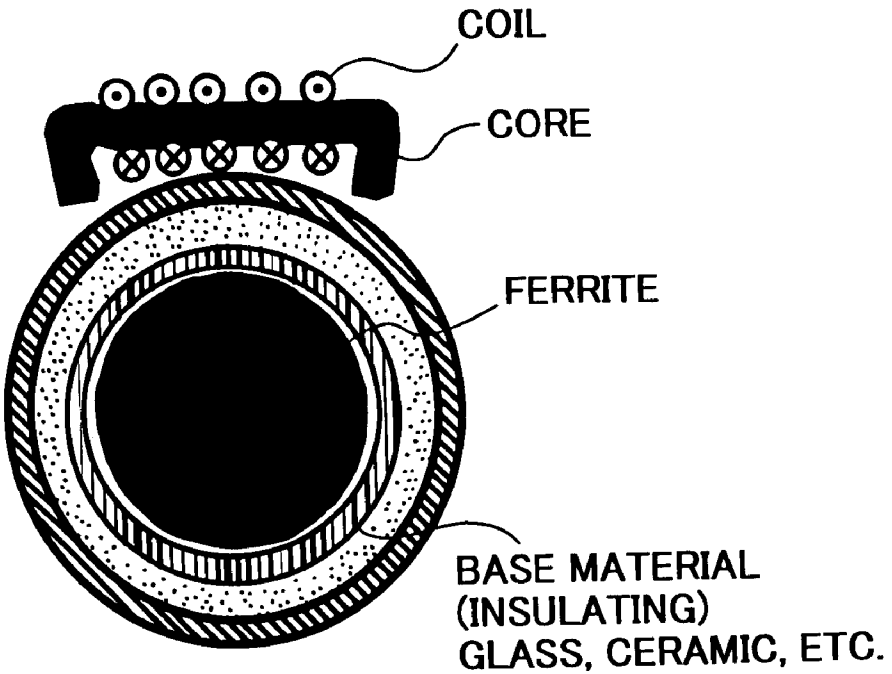
Figure 11C:
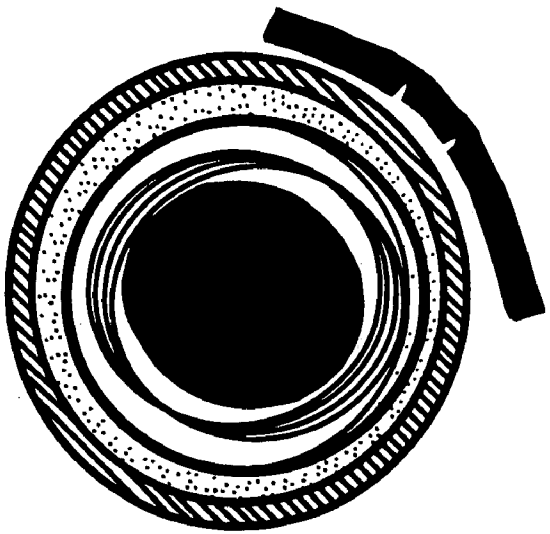
Figure 11F:
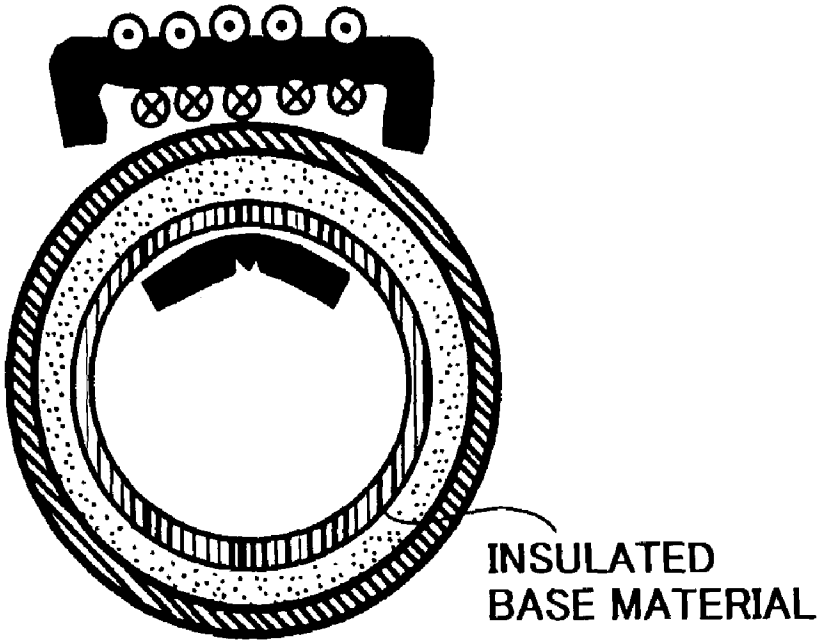
Figure 11E:
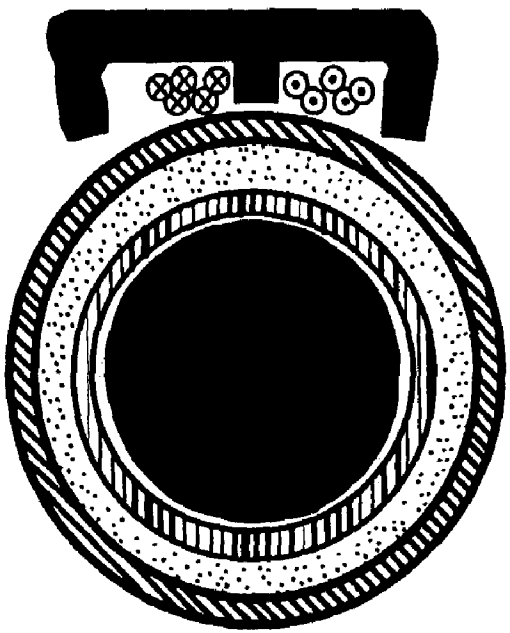

In the structure illustrated in FIG. 11D, the core with the coil wound around it is placed external to the fixing member and the yoke is placed inside the fixing member. The lines of magnetic force due to the core and the yoke are concentrated near the conductive layer. In the structure illustrated in FIG. 11E, the direction of winding of the coil and the shape of the yoke are different from those shown in FIG. 11D. In the structure illustrated in FIG. 11F, the internal yoke shown in FIG. 11D is downscaled to a required size. In the structure illustrated in FIG. 11G, the internal yoke shown in FIG. 11E is downscaled to a required size. In the structure illustrated in FIG. 11H, the center is occupied by a non-magnetic metal around which a ferrite layer or a layer of ferrite hardened with heat resistant resin or ceramic is disposed. The ferrite layer controls lines of-magnetic force does not allow the central metal to get heated. In the structure illustrated in FIG. 11I, the direction of winding of the coil and the shape of the yoke are different from those shown in FIG. 11H.

In the structures shown in FIG. 11A through 11I, only a single conductive layer has been depicted. It is advantageous from the viewpoint of flexibility to have a thin conductive layer if it is close to the surface. However, it is also possible to have a double-conductive layer structure by having a first conductive layer close to the surface and a second conductive layer a little away from the surface. In this structure, the heating rate of the first conductive layer can be reduced. FIG. 11J illustrates such a structure. A conventionally known material that is somewhat inferior in terms of flexibility such as a metal foil can be used as the second conductive layer.

Figure 12A:
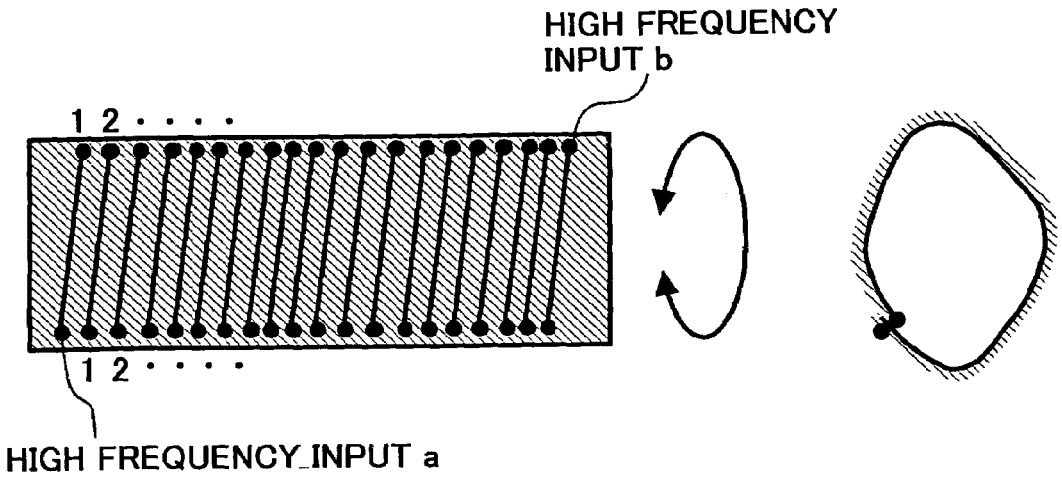
FIG. 12A and FIG. 12B illustrate an example of a coil which is made by winding a thin wire over a base material that is rolled such that the front and the backside of the base material overlap.
Figure 12B:
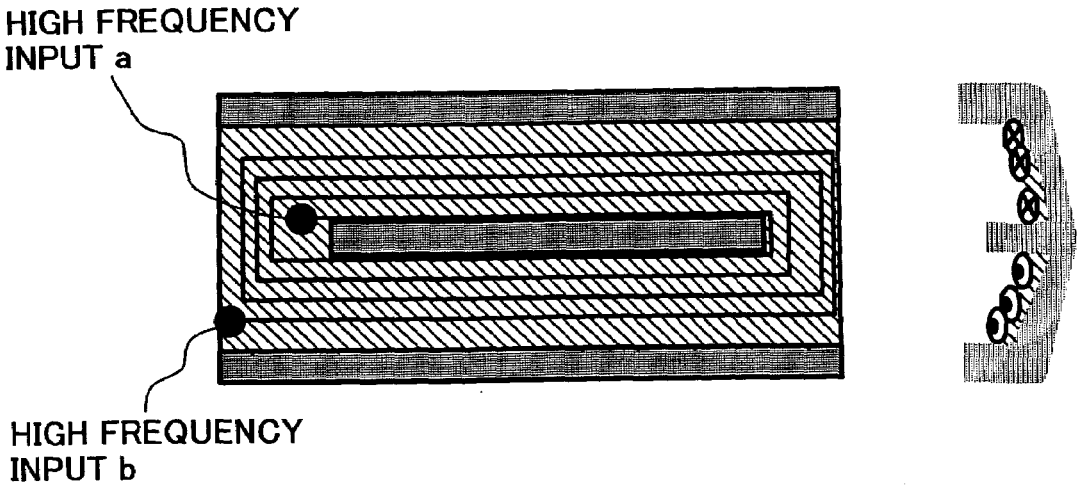

Simplification of induction coil in a fixing device employing induction heating has been a constant challenge. Litz wire may be used as the induction coil. Alternatively, as shown in FIG. 12A, a lightweight coil obtained by rolling up a flexible polyimide board and winding thin wires around it so that the ends of the wires connect (1 connects with 1, 2 with 2, and so on) at the overlapping portion of the flexible board.

Figure 11I:
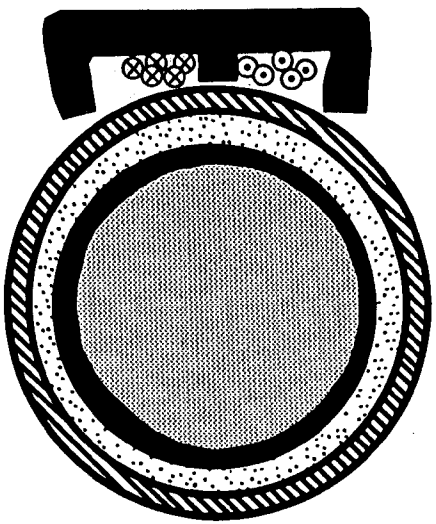
Figure 11H:
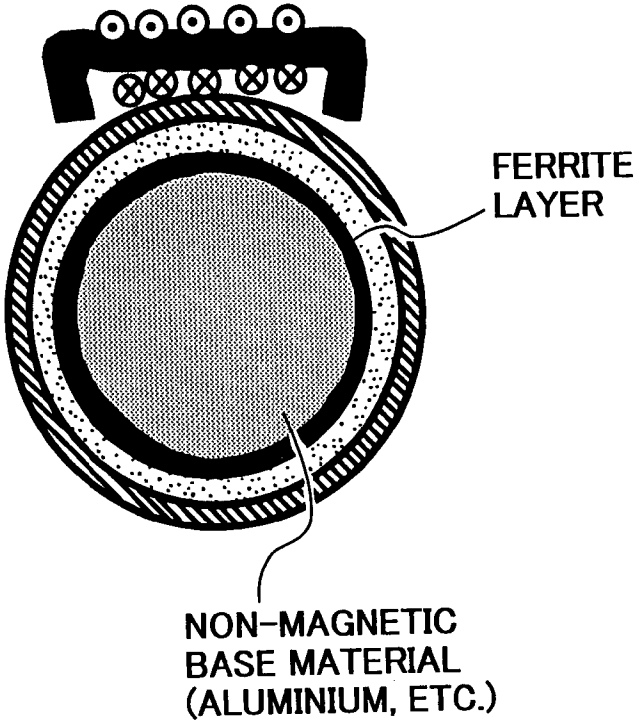
Figure 11G:
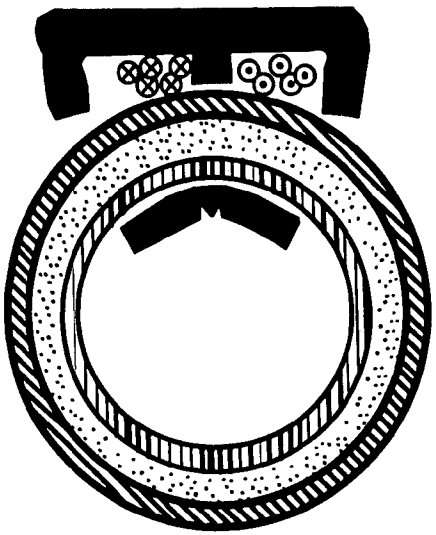
Figure 11J:
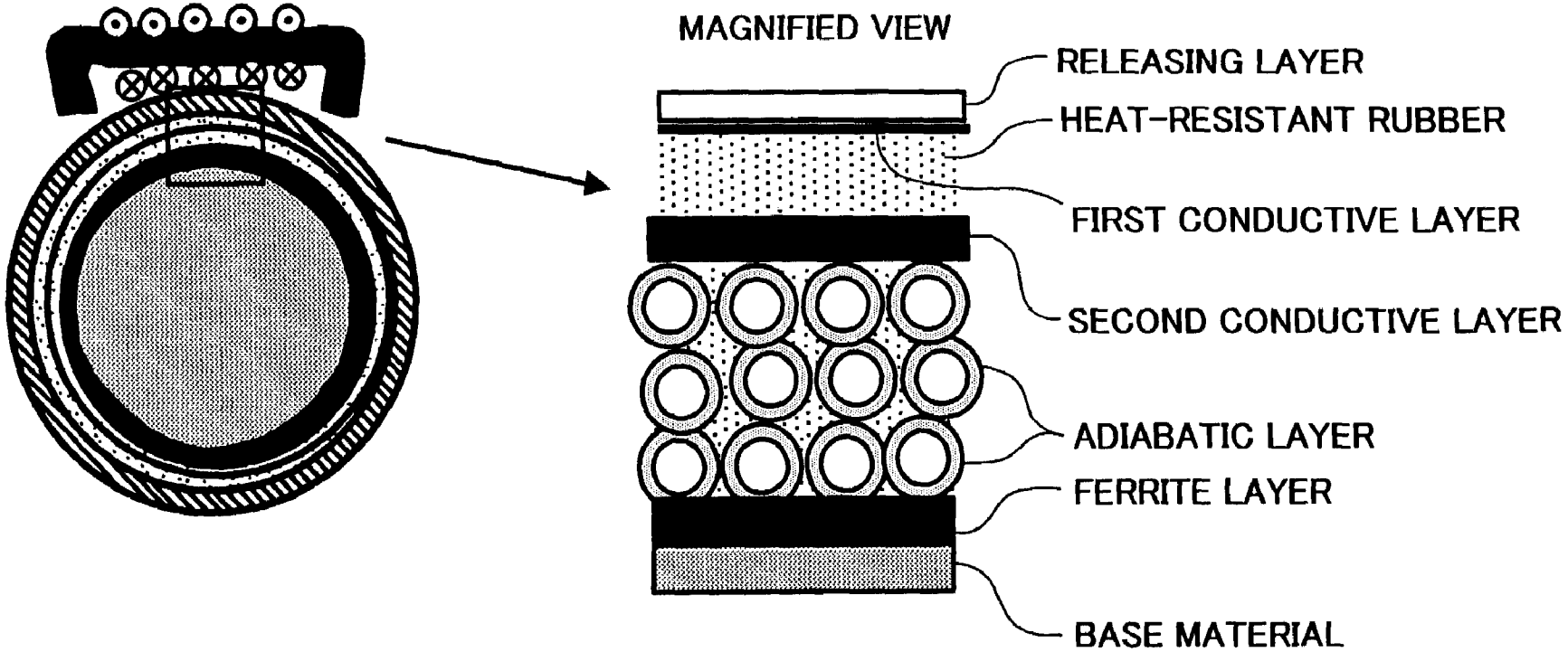

For the structures illustrated in FIG. 11E, FIG. 11G, and FIG. 11I, a single layer or plural layer of coil may be wound around the base material and a coil may be formed by assembling the coil-around-base material with a core. In particular, coil having a special shape, parallel coil, etc. are ideal. When the thin wires are placed in parallel, the surface area of the thin wire increases and a high-frequency current can be obtained as in the litz wire. This coil is not restricted to the fixing member described in claims 1 through 7 and can be used for induction heating of any kind.

Figure 13:
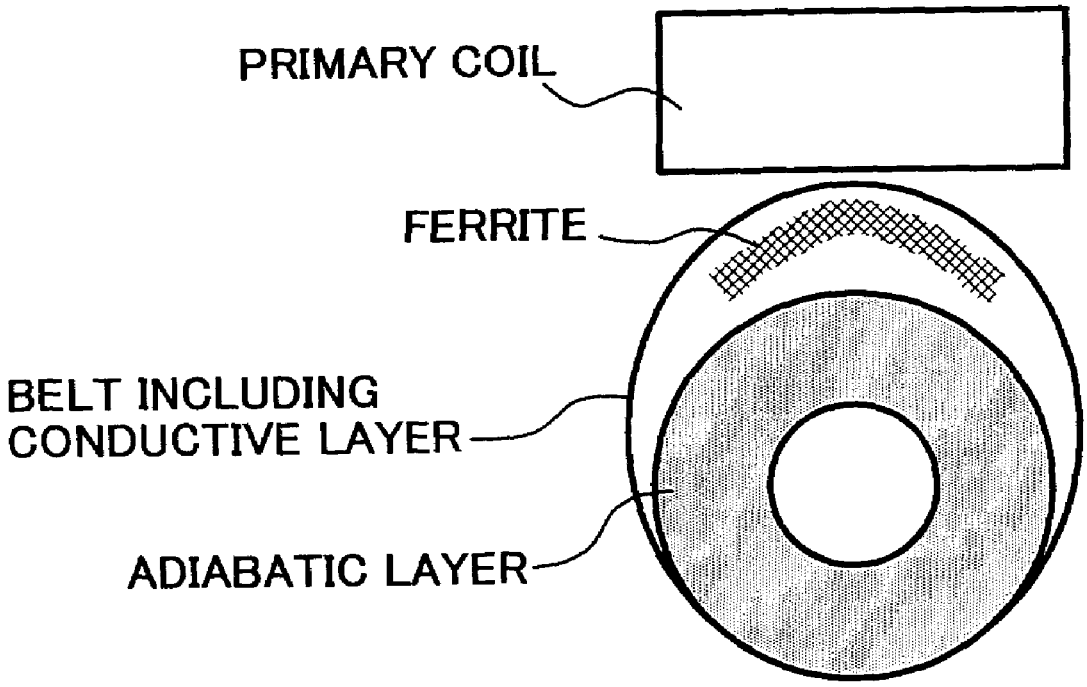
FIG. 13 is a conceptual drawing of a belt shaped fixing member.

The layer structure and the conductivity process have been described above for the intermediate elastic layer disposed between the adiabatic layer and the releasing layer of the fixing roller. These are also applicable to the intermediate elastic layer of a fixing belt. In the case of the fixing belt, the belt lies where the adiabatic layer should be and the thickness of the belt ranges from 30 μm to 100 μm. FIG. 13 is a drawing illustrating a belt-type fixing member according to the present invention. If the belt base material is a very thin polyimide board of a thickness of 50 μm or less, the amount of moisture absorbed will be negligible and the moisture is likely to drain from the bottom surface of the belt. If the belt is as thin as 30 μm, durability under the existing conditions may be compromised.

Along with heating of the conductive layer according to the present invention, other heating methods such as using another heat-producing layer, or using alternative heating methods such as by radiation, etc., may also be effectively used.

According to one aspect of the present invention, the conductive layer can be prevented from peeling off due to absorption of moisture. Further, the conductive layer is insulated by the space. The heat is therefore shunted towards the surface. Consequently, the heating rate close to the surface improves.

When the conductive layer is disposed exterior to a hollow fiber, and a heat-resistant rubber is used as a binder, the fiber itself is rendered flexible. Further, using a thin rubber layer helps obtain high quality image. The hollow fiber allows continuous conduction and is easy to manufacture.

When the conductive layer is disposed on the outer periphery of a cylindrical base material and a bump is disposed on the inner periphery of the cylindrical base material, and the space for the release of the moisture is formed by the convex part of the bump touching an adjoining layer, an even conductive layer and therefore an even heating is obtained, as compared to when the conductive layer is disposed on the surface of the fiber.

The conductive layer has an elastic hydrophobic heat-resistant material on its surface, a hygroscopic heat-resistant material on its underside, and space on the side of the underside of the conductive layer for the release of the moisture absorbed by the hygroscopic heat-resistant material. Consequently, the conductive layer can be prevented from peeling off due to absorption of moisture.

When the conductive layer is between two heat-resistant rubber layers and the deformation of the rubber layers is 10% or less, even if the outermost releasing layer gets damaged, there is a very low possibility of the heat-producing conductive layer to be affected. Further, the conductive layer is unaffected by the deformation of the rubber layers.

When the conductive layer is chemically coupled with at least one of the layers adjoining it, the strong coupling ensures that the conductive layer does not peel off even upon bending. A thin conductive layer with excellent flexibility can be heated by an induction current produced in a secondary coil in a structure in which the secondary coil is magnetically coupled with a primary coil and the primary coil and the secondary coil exist as a single unit.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A rotational member comprising:

a hydrophobic layer;

a hygroscopic layer below the hydrophobic layer; and a plurality of cavities that extend substantially parallel to each other, that are formed in the hygroscopic layer, and that are configured to release moisture from the rotational member that is absorbed by the hygroscopic layer.

2. The rotational member according to claim 1, wherein the hygroscopic layer comprises a plurality of hollow fibers.

3. The rotational member according to claim 2, wherein the hygroscopic layer comprises a binder that binds the plurality of hollow fibers together.

4. The rotational member according to claim 1, wherein the hygroscopic layer has a convex part, and the plurality of cavities are formed as the convex part is linked to an adjacent layer.

5. An image forming apparatus including the rotational member according to claim 1.

6. An image forming apparatus including the rotational member according to claim 2.

7. An image forming apparatus including the rotational member according to claim 3.

8. A fixing device comprising:

a fixing member;

a pressure member disposed opposing to the fixing member; and a nip formed by the pressure member, wherein at least one of the fixing member and the pressure member comprises a hygroscopic layer located below a hydrophobic layer, and a plurality of cavities that extend substantially parallel to each other, that are formed in the hygroscopic layer, and that are configured to release moisture from the rotational member that is absorbed by the hygroscopic layer.

9. An image forming apparatus including the fixing device according to claim 8.

10. A fixing device comprising:

a fixing member;

a pressure member disposed opposing to the fixing member; and a nip formed by the pressure member, the fixing member comprising:

a hydrophobic layer;

a hygroscopic layer located below the hydrophobic layer; and a plurality of cavities that extend substantially parallel to each other, that are formed in the hygroscopic layer, and that are configured to release moisture from the rotational member that is absorbed by the hygroscopic layer, wherein the pressure member is made of an air-containing adiabatic material.

11. An image forming apparatus including a fixing device comprising:

a fixing member;

a pressure member disposed opposing to the fixing member, the pressure member made of an air-containing adiabatic material; and a nip formed by the pressure member, the rotational member comprising:

a hydrophobic layer;

a hygroscopic layer located below the hydrophobic layer; and a plurality of cavities that extend substantially parallel to each other, that are formed in the hygroscopic layer, and that are configured to release moisture from the rotational member that is absorbed by the hygroscopic layer.

12. The rotational member according to claim 1, wherein the plurality of cavities are filled with air.

13. The rotational member according to claim 1, further comprising an adiabatic layer below and in contact with the hygroscopic layer, wherein the plurality of cavities are cavities formed on a surface of the hygroscopic layer that faces the adiabatic layer.

14. The rotational member according to claim 13, wherein the cavities are between 20 μm and 200 μm in height.

15. The rotational member according to claim 13, wherein the cavities are between 20 μm and 50 μm in height.

* * * * *

UNITED STATES PATENT AND TRADEMARK OFFICE

CERTIFICATE OF CORRECTION

PATENT NO. : 7,433,641 B2
APPLICATION NO. : 11/199087
DATED : October 7, 2008
INVENTOR(S) : Kikuchi et al.

It is certified that error appears in the above-identified patent and that said Letters Patent is hereby corrected as shown below:

On the title page, the Terminal Disclaimer information has been omitted. Item (45) and the Notice information should read:

-- (45) **Date of Patent: * Oct. 7, 2008**

(*) Notice: Subject to any disclaimer, the term of this patent is extended or adjusted under 35 U.S.C. 154(b) by 0 days.

This patent is subject to a terminal disclaimer. --

Signed and Sealed this

Second Day of December, 2008

JON W. DUDAS
*Director of the United States Patent and Trademark Office*